US008967280B2

(12) United States Patent
Doane et al.

(10) Patent No.: US 8,967,280 B2
(45) Date of Patent: Mar. 3, 2015

(54) LOCKING ASSEMBLY FOR MECHANICALLY SET PACKER

(75) Inventors: James C. Doane, Friendswood, TX (US); Gary L. Anderson, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 670 days.

(21) Appl. No.: 13/099,451

(22) Filed: May 3, 2011

(65) Prior Publication Data

US 2012/0279701 A1 Nov. 8, 2012

(51) Int. Cl.

| | |
|---|---|
| ***E21B 23/06*** | (2006.01) |
| ***E21B 33/12*** | (2006.01) |
| ***E21B 33/129*** | (2006.01) |

(52) U.S. Cl.

CPC ..... *E21B 33/1291* (2013.01)
USPC ..... 166/383; 166/120; 166/323; 166/387

(58) Field of Classification Search

USPC ..... 166/381, 383, 387, 373, 120, 323
See application file for complete search history.

(56) References Cited

U.S. PATENT DOCUMENTS

| | | | | |
|---|---|---|---|---|
| 5,320,183 | A | 6/1994 | Muller et al. | |
| 5,692,564 | A * | 12/1997 | Brooks | 166/127 |
| 6,607,037 | B2 * | 8/2003 | Thompson | 166/332.1 |
| 6,651,750 | B2 * | 11/2003 | Whitsitt | 166/387 |
| 7,735,560 | B2 | 6/2010 | Bane et al. | |
| 8,261,836 | B2 * | 9/2012 | Noske et al. | 166/332.8 |
| 2002/0157831 | A1 * | 10/2002 | Kurlenya et al. | 166/302 |
| 2012/0234530 | A1 * | 9/2012 | Tait | 166/66.5 |
| 2013/0213635 | A1 * | 8/2013 | Carro | 166/120 |

* cited by examiner

*Primary Examiner* — Catherine Loikith
(74) *Attorney, Agent, or Firm* — Steve Rosenblatt

(57) ABSTRACT

A lock assembly for a mechanically set packer for deep deployments is described. The lock housing wall has at least one bore for a rod piston that is selectively actuated when wellbore hydrostatic is allowed to reach on side of the piston. Movement of the piston, after breaking a shear pin, allows a c-ring to spring outwardly and out of a locking groove in the mandrel so that the mandrel can be string manipulated with respect to the housing to set the packer. Once unlocked the lock assembly remains defeated. The piston can be optionally exposed to hydrostatic and will unlock at a given depth without manipulation of the wellbore annulus pressure. Other mechanisms to admit wellbore hydrostatic to move the piston or to move the piston in general by other techniques are described.

18 Claims, 9 Drawing Sheets

LOCKING ASSEMBLY FOR MECHANICALLY SET PACKER

FIELD OF THE INVENTION

The field of the invention is locks that keep mechanically set packers from setting prematurely and more particularly techniques for providing housings in very deep applications that have sufficient pressure rating while functioning as a releasable lock assembly.

BACKGROUND OF THE INVENTION

Mechanically set packers typically involve a set of drag block so that one component of two that are relatively moveable with respect to the other can be held stationary while a mandrel is moved generally axially for setting the packer. Typically a j-slot assembly connects the stationary and the movable components so that reciprocation of the string in combination with the j-slot mechanism induces a rotational movement as a pin follows a slot so that the packer is not only set but the set condition is locked. Reversal of the movement with have the pin follow the slot in reverse to release the mechanically set packer as the slips have the cones pulled out from under them that in turn allows the compressed sealing element to reduce in diameter and increase in length so that the assembly can be removed from the wellbore using the string that supports the packer mandrel.

Getting the packer to the desired location especially in a deviated borehole involves string manipulation in the axial and rotational directions where the packer body can scrape the casing or tubing. If the setting mechanism was not locked during run in it is possible that the packer manipulations to get it to the desired location could inadvertently set it. This would be disadvantageous especially if the packer was not of a retrievable design. In those cases it would require a release from the packer and another trip into the wellbore to mill it out with a mill. Even if the packer is resettable, it can be damaged by being forced to the desired location if it is in the deployed position.

The lock to prevent packer setting has to be a compact design so that it will not increase the drift dimension of the packer assembly during run in. The design also has to operate reliably and to be cost effective. One way to keep the cost down for such a lock assembly is to have it release in response to annulus pressure above a predetermined value. One such design that has been developed is shown in U.S. Pat. No. 5,320,183 where access to annulus pressure is made available upon a pressure buildup to a predetermined value in the annulus that opens a barrier to let that pressure into a chamber 30c3a that in turn pushes on an annular piston 30b3a shown in FIG. 2 so that the sleeve 30c2, 30c1 moves down and the dogs 30a move out of groove 10a. The mandrel 10 can then be manipulated. An alternative embodiment removes support for a dog extending into the mandrel to fixate it and in the process pulls a sleeve into the groove that the dog has vacated as a result of initial mandrel movement. The actuation of the sleeve to remove support for the dogs does not remove the dogs from their groove until after sleeve movement and mandrel manipulation. The subsequent covering of the groove formerly occupied by the dogs is taken to insure that the dogs cannot get back into the groove and prevent relative movement with respect to the packer that is now in the process of being set.

As packer setting locations get deeper the pressure rating of housings to withstand the higher hydrostatic forces from such depths has to be much higher than previously needed. The use of an annular piston as described above forces a reduction in wall thickness for the housing as there has to be a large annular volume to accommodate the piston and its travel distance. This forces a thinner housing wall in a location with a given drift diameter. Below certain depths such a design is not serviceable as the pressure rating on the housing cannot meet system requirements.

The present invention addresses the need for a higher housing pressure rating with a thicker wall made possible by drilling a piston bore into the housing wall in which is located a rod shaped piston. At a predetermined pressure the annulus pressure is allowed to communicate to one side of the piston that had preferably been at atmospheric pressure. The opposite side of the piston is preferably at atmospheric pressure so that the resulting piston movement liberates a c-ring that had previously extended into a mandrel groove to prevent relative movement between the housing and the mandrel. The c-ring is manufactured so that it springs away from the groove when the piston is stroked so that the c-ring will not re-engage the groove once the lock assembly is unlocked. These details and others about the present invention will be more readily apparent to those skilled in the art from a review of the details of the preferred embodiment and other embodiments described below while realizing that the full scope of the invention is to be determined by the appended claims.

SUMMARY OF THE INVENTION

A lock assembly for a mechanically set packer for deep deployments is described. The lock housing wall has at least one bore for a rod piston that is selectively actuated when wellbore hydrostatic is allowed to reach one side of the piston. Movement of the piston, after breaking a shear pin, allows a c-ring to spring outwardly and out of a locking groove in the mandrel so that the mandrel can be string manipulated with respect to the housing to set the packer. Once unlocked the lock assembly remains defeated. The piston can be optionally exposed to hydrostatic and will unlock at a given depth without manipulation of the wellbore annulus pressure. Other mechanisms to admit wellbore hydrostatic to move the piston or to move the piston in general by other techniques are described.

DETAILED DESCRIPTION OF THE PREFERRED EMBODIMENT

Figure 1:
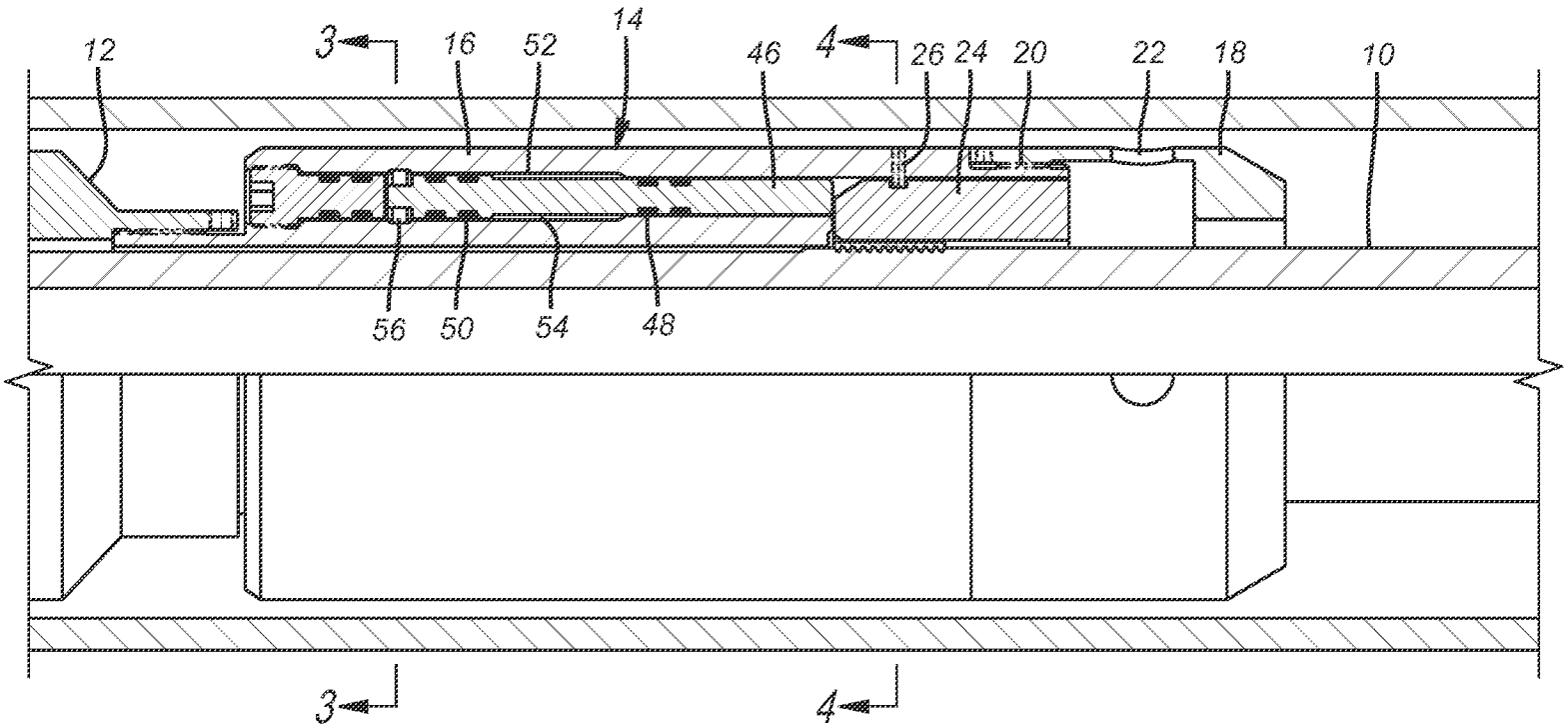
FIG. 1 is a section view of the lock assembly in the run in position.

The mechanically set packer is very well known to those skilled in the art so it is not shown in detail in the drawings. It suffices to state that the packer can be selectively set by manipulation of the mandrel 10 with respect to the packer body, a portion of which 12 is shown in FIG. 1. Generally drag blocks that are not shown are used to hold the packer body in position as the mandrel 10 is manipulated with respect to the packer body 12 generally using a j-slot or equivalent to get the sealing element compressed and the cones under slips to lock in the set position of the sealing element. As stated before, the packer cannot set until there is relative movement between the mandrel 10 and the packer body 12.

Figure 2:
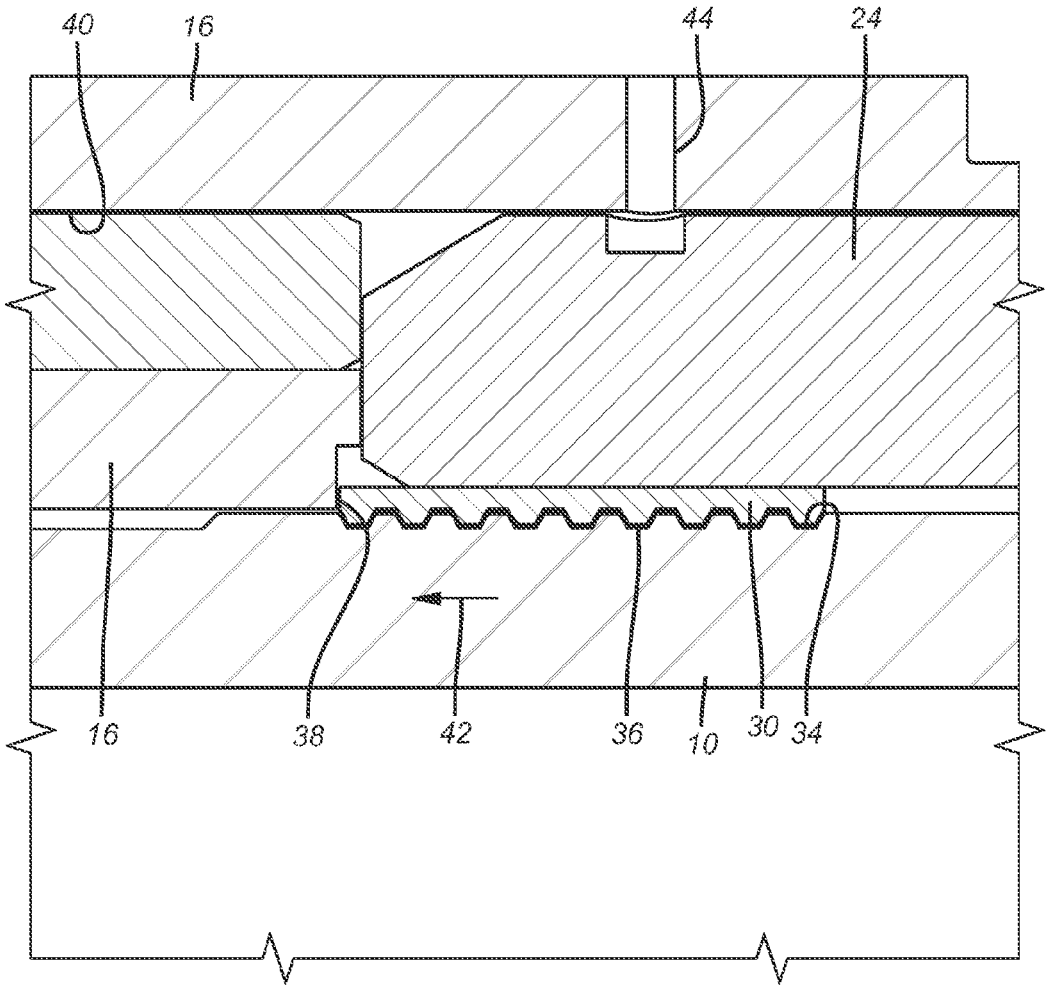
FIG. 2 is a close-up view of FIG. 1 focusing on the c-ring design.
Figure 4:
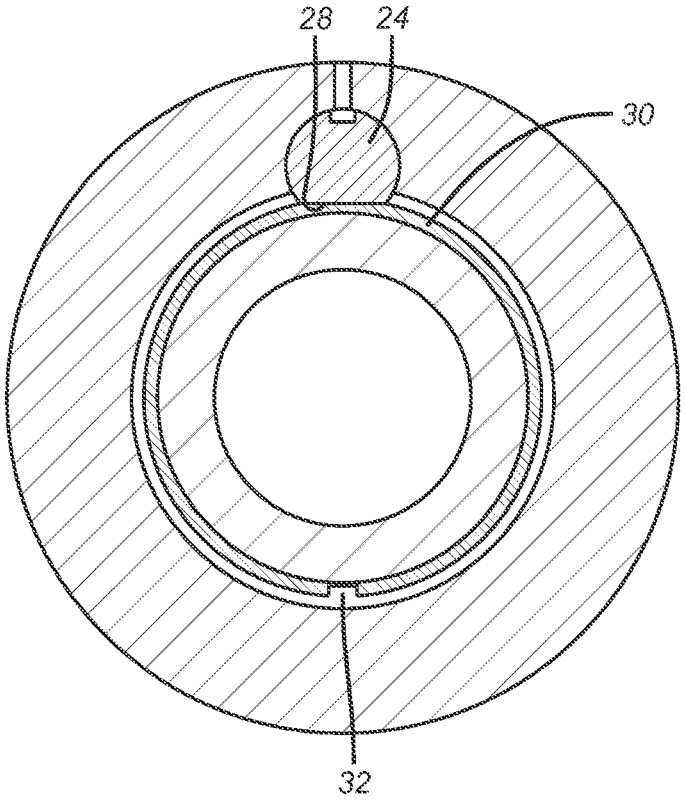
FIG. 4 is a view along line 4-4 of FIG. 1.

What prevents such relative movement is the lock housing 14 that has a body 16 and a bottom sub 18 connected at thread 20 with a fluid displacement port 22 in the bottom sub 18. A retainer 24 that is also shown in the section view of FIG. 4 is generally rounded in shape and preferably has a flat 28 that faces the c-ring 30 preferably at 180 degrees from the split 32. Shear pin 26 initially fixates the retainer 24 in such a manner as to have the c-ring 30 supported in groove 34 and as shown in FIG. 2 the groove 34 is made up of a series of spaced grooves that match a profile 36 on the face of the c-ring 30 that faces the mandrel 10. End 38 abuts housing 16 that is part of the packer body 12 to prevent uphole movement in the direction of arrow 42 until after the c-ring 30 is released by movement of the retainer 24. Bore 44 in FIG. 2 accepts the shear pin or pins 26.

Going back to FIG. 1 the housing 16 has at least one bore 40 in which piston 46 resides for slidable movement. Seals 48 are a smaller diameter than seals 50 which reside in a larger diameter portion 52 of the bore 40. In between seals 48 and 50 is a chamber 54 that is preferably at atmospheric pressure but can be higher. Above the piston 46 is another chamber 56 also seen in FIG. 3. This chamber is defined by a rupture disc retainer 58 held by a lock nut 60 threaded in bore 62. Bore 62 is preferably at 90 degrees to the piston bore 40 and communicates to the annular space 64 surrounding the lock housing 14.

When the mechanically set packer is at the desired location and it is time to set it, the pressure in the annulus 64 is raised or reaches a predetermined level and the rupture disc 59 breaks to communicate pressure in the annulus 64 into chamber 56 to start driving the piston 46. Initially the shear pin 26 breaks after which further piston 46 movement pushes the retainer 24 to a location offset from the c-ring 30 which allows the stored potential energy in c-ring 30 to be released as the c-ring 30 springs to a larger diameter taking the profile 36 out of the facing groove 34 that has a similar profile. The c-ring 30 is then no longer in the groove 34 of the mandrel 10 and the mandrel 10 may now be manipulated axially and/or rotationally to set the packer using relative movement of the mandrel 10 to the packer body 12 that is in most cases supported in the wellbore with drag blocks (not shown).

Figure 3:
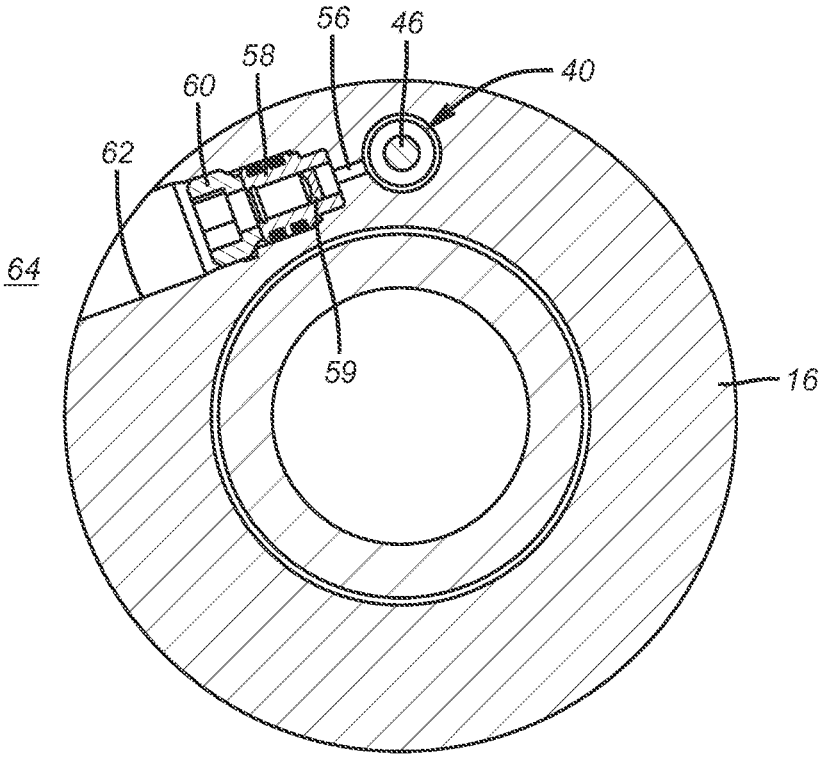
FIG. 3 is a view along section lines 3-3 of FIG. 1.
Figure 5:
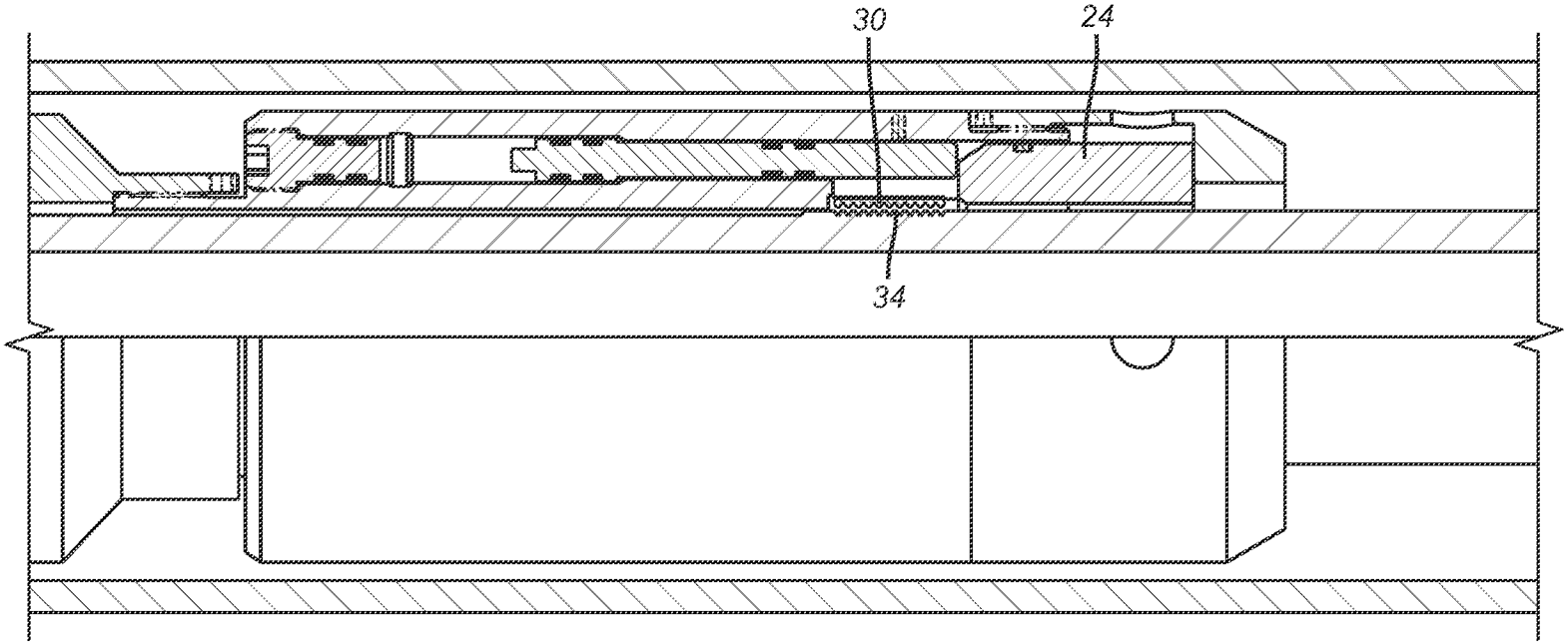
FIG. 5 is a released view of the lock assembly shown in FIG. 1.

The advantage of the present design can be readily seen from the drawings and the above description. The housing 16 can have a massive wall thickness as shown in FIG. 3 that is interrupted by the bore 40 for each respective piston 46. In well depths of 20,000 feet or more the hydrostatic pressures can be so high that a very thick wall for housing 16 is necessary to get the required pressure rating which can range in the order of 20,000 PSI or more depending on the depth and fluid density in the annular space. Using a smaller bore for a piston 46 allows the ability to withstand such high differential pressures with minimal or no bore distortion. As shown in FIG. 5, once the c-ring 30 is sprung, its built in potential energy keeps it in the FIG. 5 position and out of the groove 34 so that once there is an unlocking of the mandrel 10 to move with respect to the packer body portion 12 there is no risk of a re-latching that could otherwise prevent the packer from fully setting.

There are options that can be employed. For example, the c-ring 30 that is shown in FIG. 2 as retained against movement in the direction of arrow 42 can also be retained against axial movement in opposed directions. The use of the rupture disc 59 is optional and it can be omitted. This would let hydrostatic pressure in the annulus 64 act on the piston 46 as the packer body 12 is lowered. At some predetermined depth that results in the breakage of the shear pin 26 the packer will be unlocked to set and prevented from relocking as previously described.

Rather than using a rupture disc to communicate pressure in annulus 64 to the piston 46 some other type of device can be used. The valve can be a smart valve with an associated operator and a power supply and processor to receive signals from the surface to trigger the valve to open when desired. For some examples the sensor associated with the valve can be responsive to a predetermined movement in opposed directions of the packer body, an acoustic signal through the supporting tubular string or the annulus fluid or an applied magnetic field such as with the delivery of a sonde through the supporting string.

Figure 6:
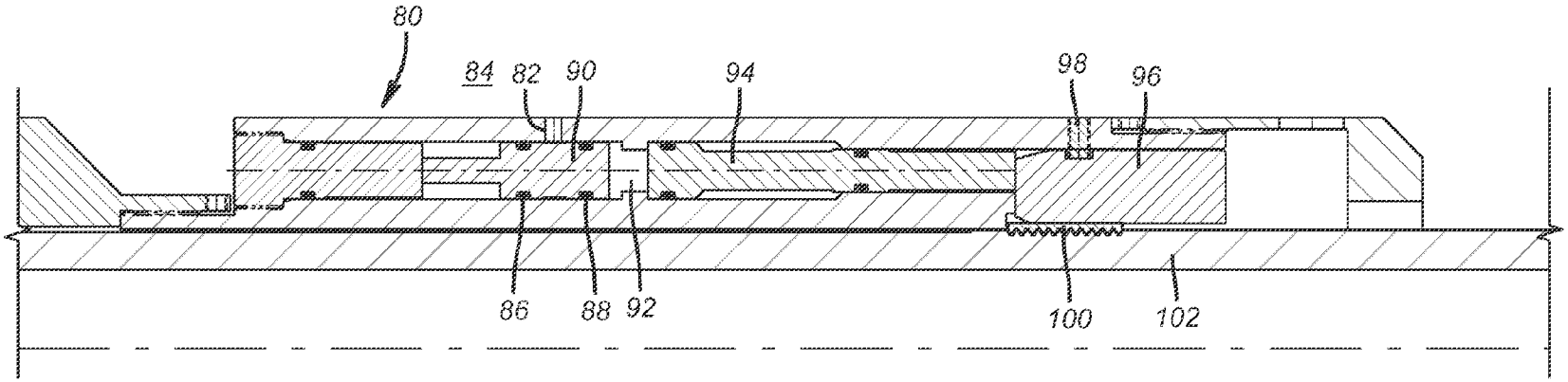
FIG. 6 shows the use of a solenoid valve to admit annulus pressure to defeat the lock with the solenoid in the closed position and the lock in the locked position.
Figure 7:
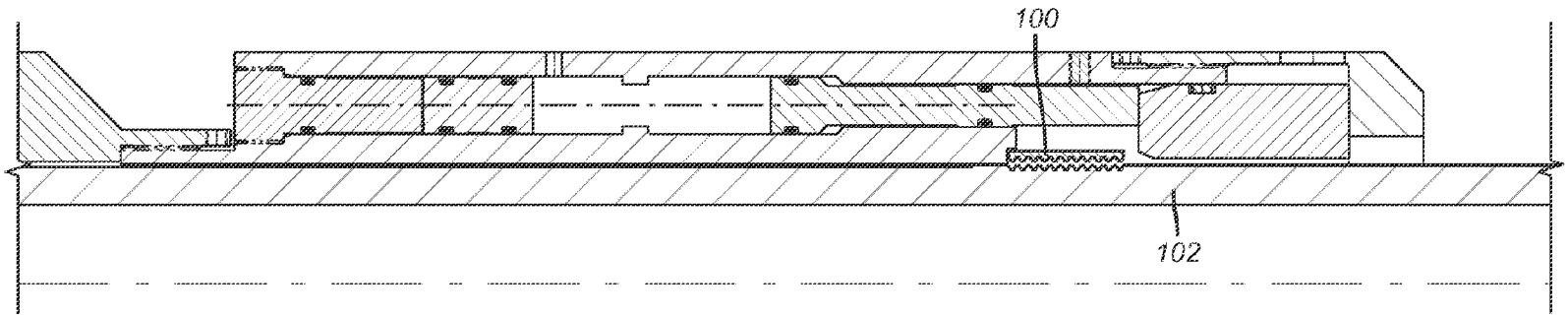
FIG. 7 is the view of FIG. 6 with the lock defeated by operation of the solenoid.

FIGS. 6 and 7 illustrate an example of this in the form of a solenoid valve 80 that initially blocks a port 82 to the annulus 84 using seals 86 and 88 on a valve member 90. When a signal makes the valve member 90 move uphole, the seal 88 is pulled past the port 82 allowing annulus pressure into chamber 92 to push the piston 94 against the retainer 96 to break the shear pin 98 so that the lock ring 100 is no longer supported and can spring away from the mandrel 102 to which it was previously locked. FIG. 7 shows the serrations on ring 100 having parted from the mating serrations on mandrel 102 so that relative movement is now possible for setting the packer using the drag blocks and string manipulation in the manner previously described.

Figure 8:
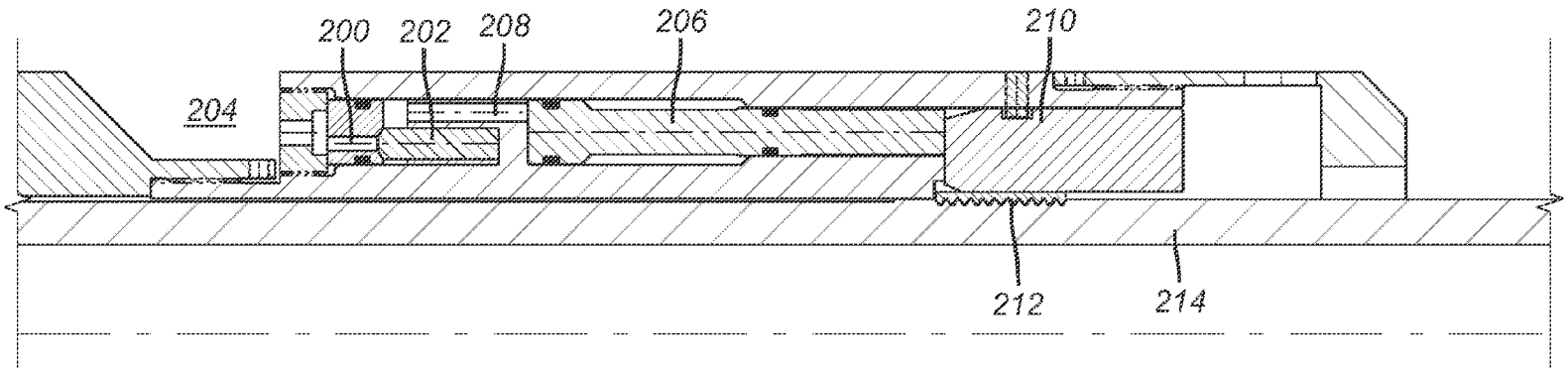
FIG. 8 is a view of the lock in the locked position using a plug to initially isolate annulus pressure.
Figure 9:
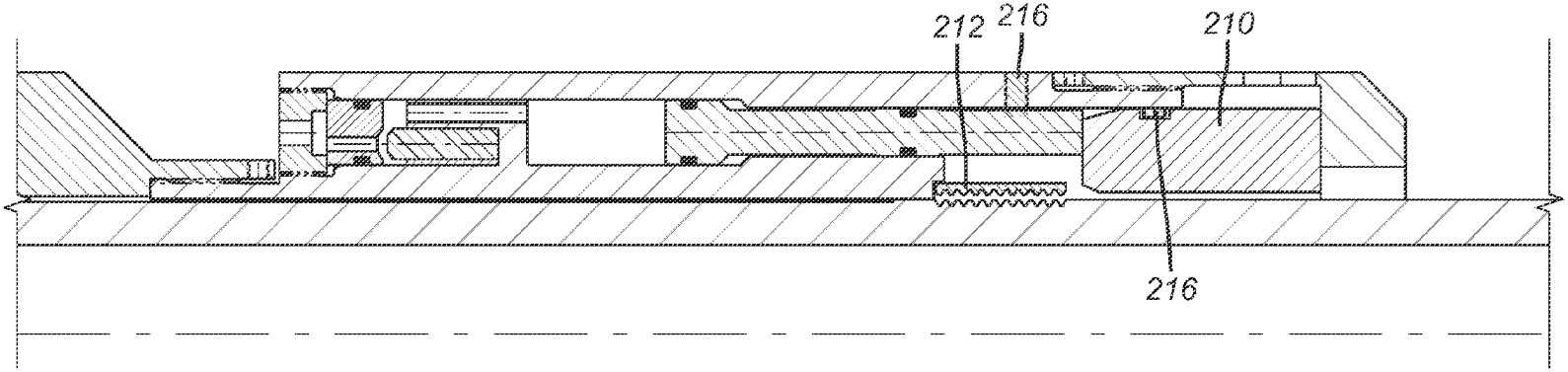
FIG. 9 is the view of FIG. 8 with the plug out of the way allowing the piston to release the lock.

FIG. 8 shows a port 200 that is blocked by a plug 202 that is a shape memory plug. On exposure to a predetermined temperature for a predetermined time the plug 202 reverts to its original smaller shape and moves away from the port 200 to allow pressure in the annulus 204 to reach the piston 206 through chamber 208. The piston moves the retainer 210 away from over the lock ring 212 and the lock ring 212 springs out and away from the mandrel 214. The packer can now be set using the drag blocks and string manipulation as previously described. FIG. 9 shows the released position with the shear pin 216 having been broken by the initial movement of the retainer 210.

Other options involve a preload force on the piston that is retained against stroking by a locking member that is defeated by well fluids such as by dissolving or other chemical attack from well fluid exposure. Another option is a piston that is made of a shape memory material that responds to the temperature of well fluids to revert to an original shape that results in liberating the c-ring to release the mandrel for movement. Instead of a c-ring, ring segments can be used that simply fall away from a profile in the mandrel when the piston shifts to remove support for the segments. More than a single piston can be used such as a symmetrical or asymmetrical array of pistons in a circumferential orientation that collectively push on a release for the mandrel lock to free the mandrel for movement such as when the rupture disc 59 breaks annulus 64 pressure can act on multiple pistons in tandem or in sequence. One or more pistons can have a plurality of axially spaced piston areas so that breaking of the rupture disc for example feeds hydrostatic pressure to the multiple piston areas to enhance the force acting on the piston. A sleeve can be used that is pushed by one or multiple pistons using wellbore annulus pressure such that the sleeve shifts enough to let the c-ring spring out or to otherwise release a locking member from a mandrel groove.

The lock can be defeated with application and removal of pressure in the annulus or in the tubing although a design without wall penetrations in the tubing is preferable tipping the balance in favor of actuation through the annulus. The annulus can be pressured against the formation for unlocking the lock to then allow setting the packer.

If the packer is releasable with string manipulation, the lock can be configured to re-latch after release to again hold the packer in the released position for removal from the wellbore. The retainer could be manipulated back toward the sprung c-ring to compress it as it is pushed back into alignment with the groove in the mandrel and the retainer can then jump over the c-ring to relock it in as the assembly is then pulled out of the hole locked in the retracted position of the packer.

The above description is illustrative of the preferred embodiment and many modifications may be made by those skilled in the art without departing from the invention whose scope is to be determined from the literal and equivalent scope of the claims below.

We claim:

1. A lock assembly for a subterranean tool that sets with mandrel movement relative to a body of the tool, comprising:

a housing supported by the tool body and having a mandrel extending into a passage in said housing;

a locking member retained in a profile on an exterior mandrel surface by a selectively movable retainer, said retainer movable to release said locking member in response to at least one pressure actuated rod mounted in at least one hydraulically pressurized bore in a wall of said housing that moves said retainer with respect to said locking member: and said rod abutting said retainer in said bore when said locking member is retained to said mandrel.

2. The assembly of claim 1, wherein:

said locking member storing potential energy when held to said mandrel by said retainer.

3. The assembly of claim 2, wherein:

said locking member releasing said potential energy after said retainer moves and moving away from said profile to a relaxed position that keeps said locking member at a larger dimension than said profile.

4. The assembly of claim 3, wherein:

said locking member comprises a c-ring.

5. The assembly of claim 4, wherein:

said profile comprises a plurality of ridges and valleys and said c-ring having a complementary shape for entering said profile.

6. The assembly of claim 1, wherein:

said rod comprises a piston selectively actuated by subterranean pressure admitted from outside of said housing.

7. The assembly of claim 6, wherein:

said piston is constantly exposed to subterranean pressure during delivery into the wellbore.

8. The assembly of claim 6, wherein:

said piston is selectively exposed to subterranean pressure upon opening of a valve.

9. The assembly of claim 8, wherein:

said valve opens automatically upon the subterranean pressure acting on it reaching a predetermined value.

10. The assembly of claim 8, wherein:

said valve stays open after opening and cannot close.

11. The assembly of claim 8, wherein:

said valve is operated with a signal that comprises at least one of: acoustic, magnetic, heat, properties of subterranean fluid and a predetermined pattern of physical movement.

12. The assembly of claim 6, wherein:

said piston defines an atmospheric chamber in said bore against which said piston moves when the subterranean pressure is admitted from outside said housing.

13. The assembly of claim 6, wherein:

said piston has a plurality of spaced apart piston areas in said bore with a plurality of housing passages to direct the subterranean pressure admitted from outside said housing.

14. The assembly of claim 1, wherein:

said rod is operated with a signal that comprises at least one of: acoustic, magnetic, heat, properties of subterranean fluid and a predetermined pattern of physical movement.

15. The assembly of claim 14, wherein:

said rod comprises a shape memory material that changes length on exposure to heat to move said retainer with respect to said locking member.

16. The assembly of claim 1, wherein:

said at least one rod comprises a plurality of rods;

said retainer comprises a cylinder selectively moved by said plurality of rods.

17. The assembly of claim 1, wherein:

said locking member is biased away from said mandrel.

18. The assembly of claim 1, wherein:

said retainer moves said locking member from a position outside said profile back into a position where said locking member is retained by said retainer in said profile.

* * * * *